US008373347B2

(12) United States Patent
Neuman

(10) Patent No.: US 8,373,347 B2
(45) Date of Patent: Feb. 12, 2013

(54) VARIABLE EFFECT LIGHT STRING

(75) Inventor: Robert C. Neuman, Cannon Falls, MN (US)

(73) Assignee: Seasonal Specialties, LLC, Eden Prairie, MN (US)

( * ) Notice: Subject to any disclaimer, the term of this patent is extended or adjusted under 35 U.S.C. 154(b) by 0 days.

(21) Appl. No.: 13/189,814

(22) Filed: Jul. 25, 2011

(65) Prior Publication Data

US 2011/0282469 A1 Nov. 17, 2011

Related U.S. Application Data

(63) Continuation of application No. 11/986,293, filed on Nov. 20, 2007, now Pat. No. 7,986,101.

(51) Int. Cl.
*H05B 39/00* (2006.01)

(52) U.S. Cl. ..... 315/200 R; 315/202; 315/205

(58) Field of Classification Search ..... 315/200 R, 315/201, 202, 203, 205
See application file for complete search history.

(56) References Cited

U.S. PATENT DOCUMENTS

| | | | | |
|---|---|---|---|---|
| 4,317,071 | A | 2/1982 | Murad | |
| 4,870,325 | A * | 9/1989 | Kazar | 315/178 |
| 4,992,704 | A | 2/1991 | Stinson | |
| 5,008,595 | A | 4/1991 | Kazar | |
| 5,066,929 | A | 11/1991 | Frantz | |
| 5,420,482 | A | 5/1995 | Phares | |
| 6,016,038 | A | 1/2000 | Mueller et al. | |
| 6,208,073 | B1 | 3/2001 | Wang et al. | |
| 6,241,362 | B1 | 6/2001 | Morrison | |
| 6,285,140 | B1 | 9/2001 | Ruxton | |
| 6,577,080 | B2 | 6/2003 | Lys et al. | |
| 6,700,333 | B1 * | 3/2004 | Hirshi et al. | 315/291 |
| 6,720,745 | B2 | 4/2004 | Lys et al. | |
| 6,777,891 | B2 | 8/2004 | Lys et al. | |
| 6,788,011 | B2 | 9/2004 | Mueller et al. | |
| 6,801,003 | B2 | 10/2004 | Schanberger et al. | |
| 6,806,659 | B1 | 10/2004 | Mueller et al. | |
| 6,827,466 | B2 | 12/2004 | Tsai | |
| 6,897,624 | B2 | 5/2005 | Lys et al. | |
| 6,965,205 | B2 | 11/2005 | Piepgras et al. | |
| 6,967,448 | B2 | 11/2005 | Morgan et al. | |
| 6,975,079 | B2 | 12/2005 | Lys et al. | |
| 7,038,398 | B1 | 5/2006 | Lys et al. | |
| 7,064,498 | B2 | 6/2006 | Dowling et al. | |
| 7,175,302 | B2 | 2/2007 | Kazar et al. | |
| 2004/0245539 | A1 | 12/2004 | Chen | |

* cited by examiner

*Primary Examiner* — Douglas W Owens
*Assistant Examiner* — Jianzi Chen
(74) *Attorney, Agent, or Firm* — Altera Law Group, LLC

(57) ABSTRACT

A light system that is controllable to generate a plurality of selected lighting effects, the light system includes a main processor, the main processor being in communication with a plurality of light sources; and each of the plurality of light sources having a distinct, known address whereby one of more of the light sources are individually addressable by the main processor, a known address being received by a selected light source of the plurality of light sources and acting to set the selected light source of the plurality of light sources in a disposition to receive a subsequent command from the main processor for generating a selected lighting effect. A light source and a method of forming a light system are further included.

13 Claims, 10 Drawing Sheets

VARIABLE EFFECT LIGHT STRING

RELATED APPLICATION

The present application claims priority to U.S. Provisional Application No. 60/860,097, filed Nov. 20, 2006, and entitled VARIABLE EFFECT LIGHT STRING, which is incorporated by reference herein in its entirety.

TECHNICAL FIELD OF THE INVENTION

The present invention relates to lighting having variable color and/or effect. More particularly, the present invention relates to a string of connected lights that are controllable to alter the color and/or the effect.

BACKGROUND OF THE INVENTION

Lighting systems in which the visual color and/or effect can be changed may be used for example for advertising, decoration, and ornamental displays. Such lighting systems typically include a plurality of individual light fixtures in communication through a continuous electrical circuit, typically called a string.

In the past, such light systems have been complex, bulky, and have not been versatile in the visual effects that can be produced. Accordingly, it remains a need in the industry for a relatively simple lighting system which allows for a greater flexibility in the visual effects generated and the range of color displayed.

SUMMARY OF THE INVENTION

The present invention substantially meets the aforementioned needs of the industry. The light string of the present invention includes a plurality of individual light sources. Each light source being in communication with the other and being individually addressable by means of a main microcontroller. The ability to individual address each of the light sources and the light string generally provides for significantly enhanced control over the visual effects generated and in the range of colors that can be produced as compared to prior art light strings. Additionally, the light string of the present invention employs a number of readily available components that are neither bulky nor unwieldy to use. By using such components, the cost of the light string of the present invention is minimized while at the same time providing for the greater range of visual displays that are available.

In its broadest form, the light string of the present invention comprises a string of light sources, preferably LED lights, in communication with a main microprocessor. The main microprocessor is in communication with a microcontroller that is associated with each light source. By this means, each light source is individually addressable by the main microprocessor in order to achieve the greater possible flexibility of visual displays available.

The present invention is a light system that is controllable to generate a plurality of selected lighting effects, the light system includes a main processor, the main processor being in communication with a plurality of light sources; and each of the plurality of light sources having a distinct, known address whereby one or more of the light sources are individually addressable by the main processor, a known address being received by a selected light source of the plurality of light sources and acting to set the selected light source of the plurality of light sources in a disposition to receive a subsequent command from the main processor for generating a selected lighting effect. The present invention is further a light source and a method of forming a light system.

In another embodiment, the light system of the present invention comprises a string of light sources, preferably LED lights, in communication with a main microprocessor. The main microprocessor is in communication with a flip-flop that is associated with each light source. By this means, the main microprocessor communicates a series of data corresponding to a lighting effect to the light sources, thereby producing a lighting effect in the light string.

Other advantages and novel features of the present invention will be drawn from the following detailed description of embodiment of the present invention with the attached drawings. The accompanying drawings are included to provide a further understanding of the invention, and are incorporated in and constitute a part of this specification. The drawings illustrate embodiments of the invention and, together with the description, serve to explain the principles of the invention.

DETAILED DESCRIPTION OF THE DRAWINGS

Figure 1:
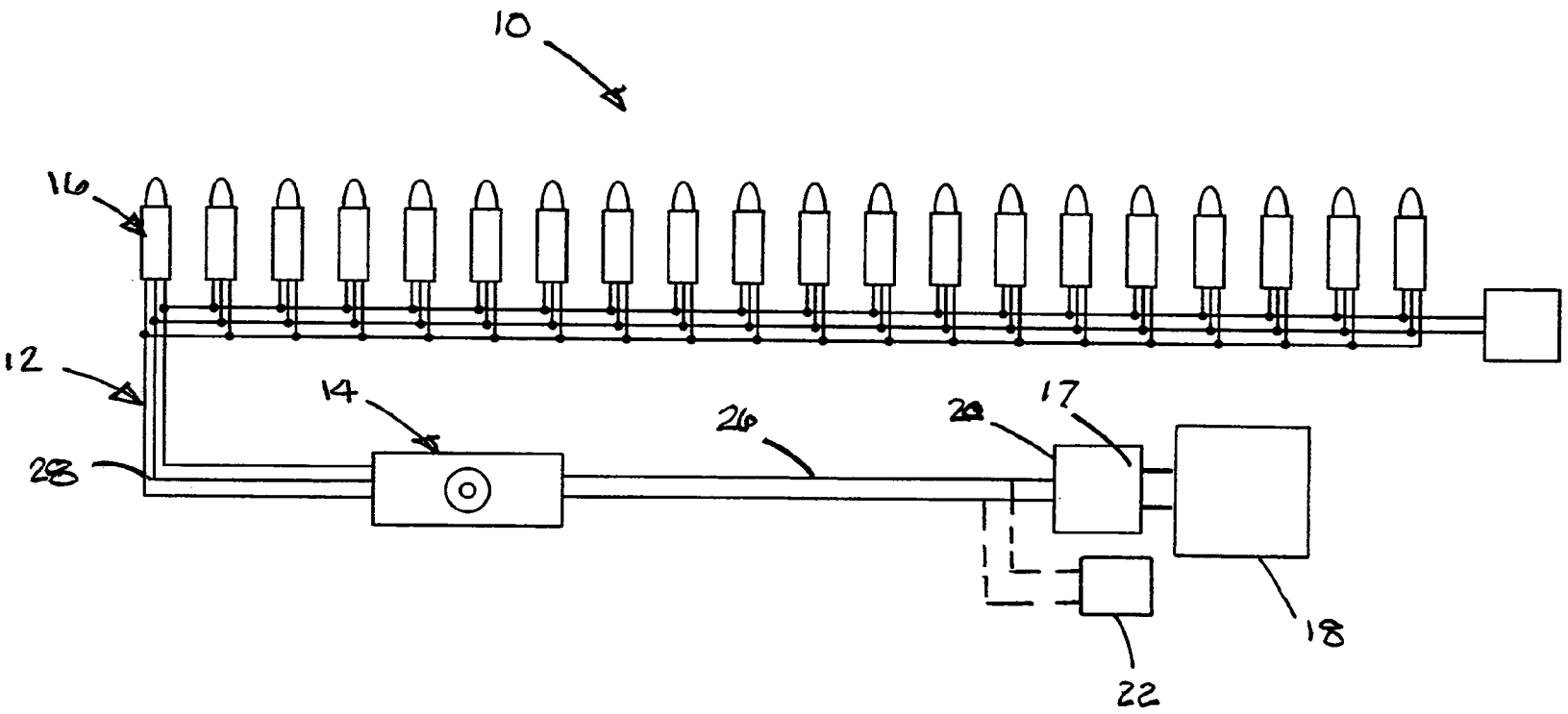
FIG. 1 is a general schematic view of the light string of the present invention.

The variable effect light string of the present invention is shown generally at 10 in the figures. Light string 10 includes three major subcomponents: communication system 12, main microprocessor 14, and a plurality of light source assemblies 16.

The communication system 12 includes a plug 17 for plugging the light string 10 into a common A/C power source 18. The power source 18 may typically be a household outlet having 60 cycle, 120 volt power. In such case, an AC/DC transformer 20 may be incorporated with the plug 17 such that the two output wires 26 convey DC power, preferably at 5.0 VDC.

Alternatively, the light string 10 may be coupled to a DC power source 22 such as would be found in a car, boat, truck, or RV type vehicle. The two wire communication 26 of the communication system 12 then is in electrical communication with the main microprocessor 14 and with either the power source 18 or power source 22, as desired.

A three wire communication 28 of the communication system 12 establishes communication between the main microprocessor 14 and each of the light source assemblies 16.

This three wire connection is preferably a DC type communication having a VDD (5V) line, a VSS (0V) line, and serial communication line. In one embodiment, the plurality of light source assemblies 16 are communicatively coupled in a parallel relationship.

The second major subcomponent of the variable effect light string 10 is the main microprocessor 14. The main microprocessor 14 includes a plurality of stored display programs that are selectable and transmittable to the individual light source assemblies 16 via the serial communication line of the three wire communication 28. It should be noted that there are a number of microprocessors currently available on the market that are adequate to satisfy the needs of the main microprocessor 14, so that no unique microprocessor device needs to be designed and manufactured, thereby assisting in making the present invention cost effective.

Figure 4:
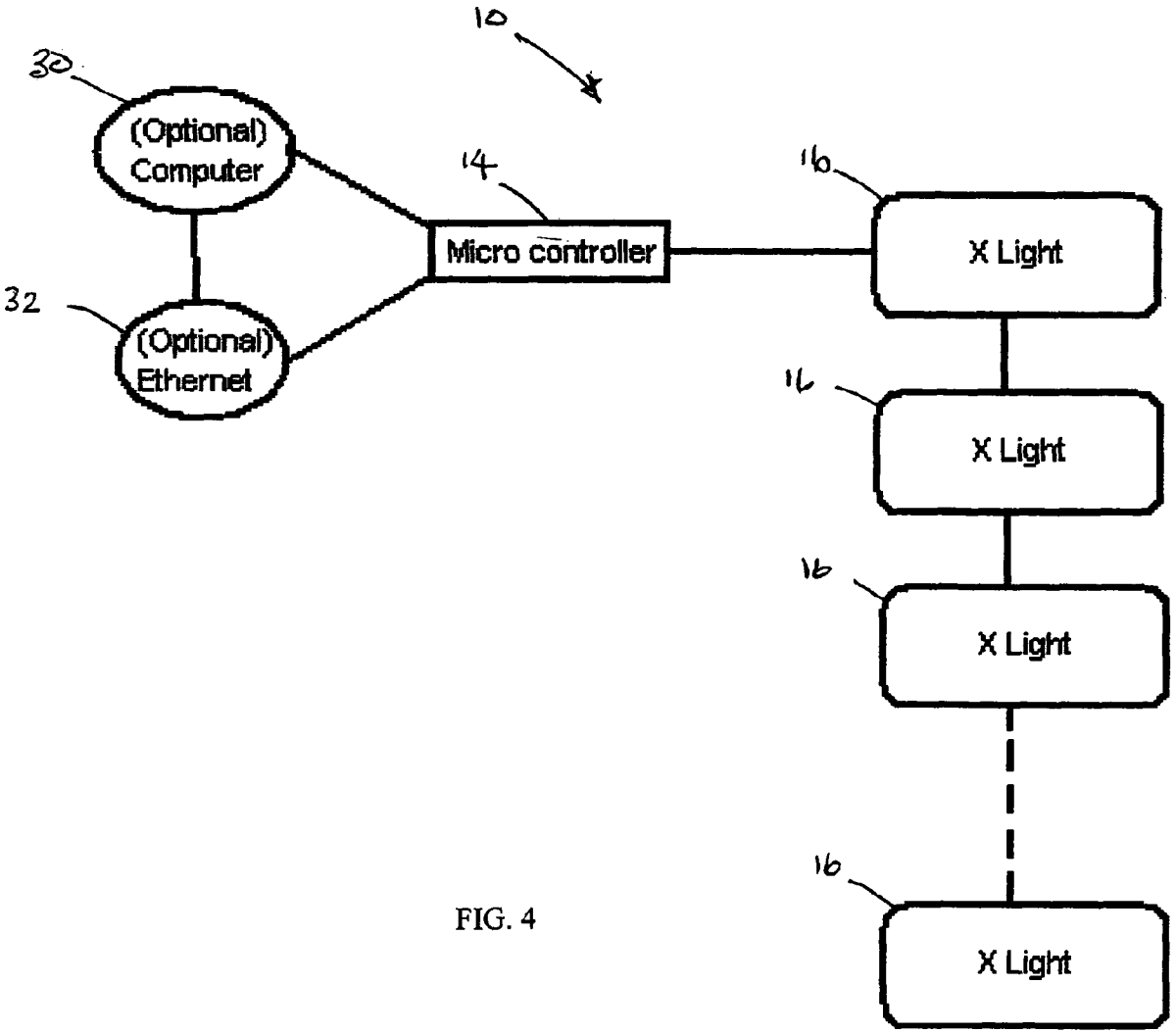
FIG. 4 is a schematic of the light string of the present invention with control by means of a computer or Ethernet.
Figure 5:
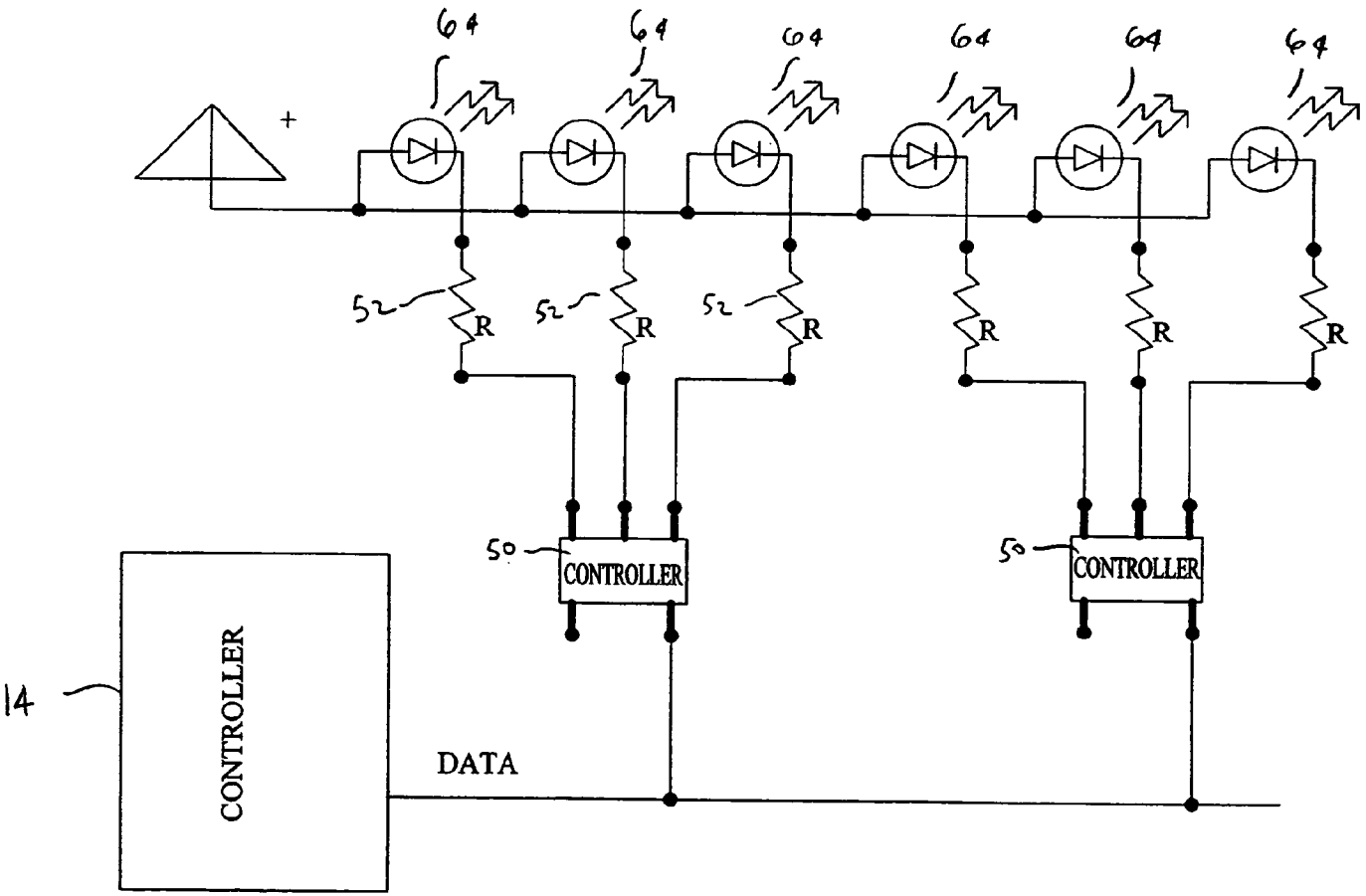
FIG. 5 is a simplified circuit diagram of the light string of the present invention.

Referring to FIG. 4, an alternative embodiment of the light string 10 is depicted in which a computer 30, preferably a PC, is coupled to the microprocessor 14 for controlling of the microprocessor 14. Additionally, ethernet 32, preferably a local area network (LAN), may also be coupled to the microprocessor 14 for the control thereof. By this means either the computer 30 or the ethernet 32 could provide additional input to the microcontroller 14 for controlling the visual effects produced by the individual light source assemblies 16 and the plurality of the individual light source assemblies 16 as a whole.

Figure 3:
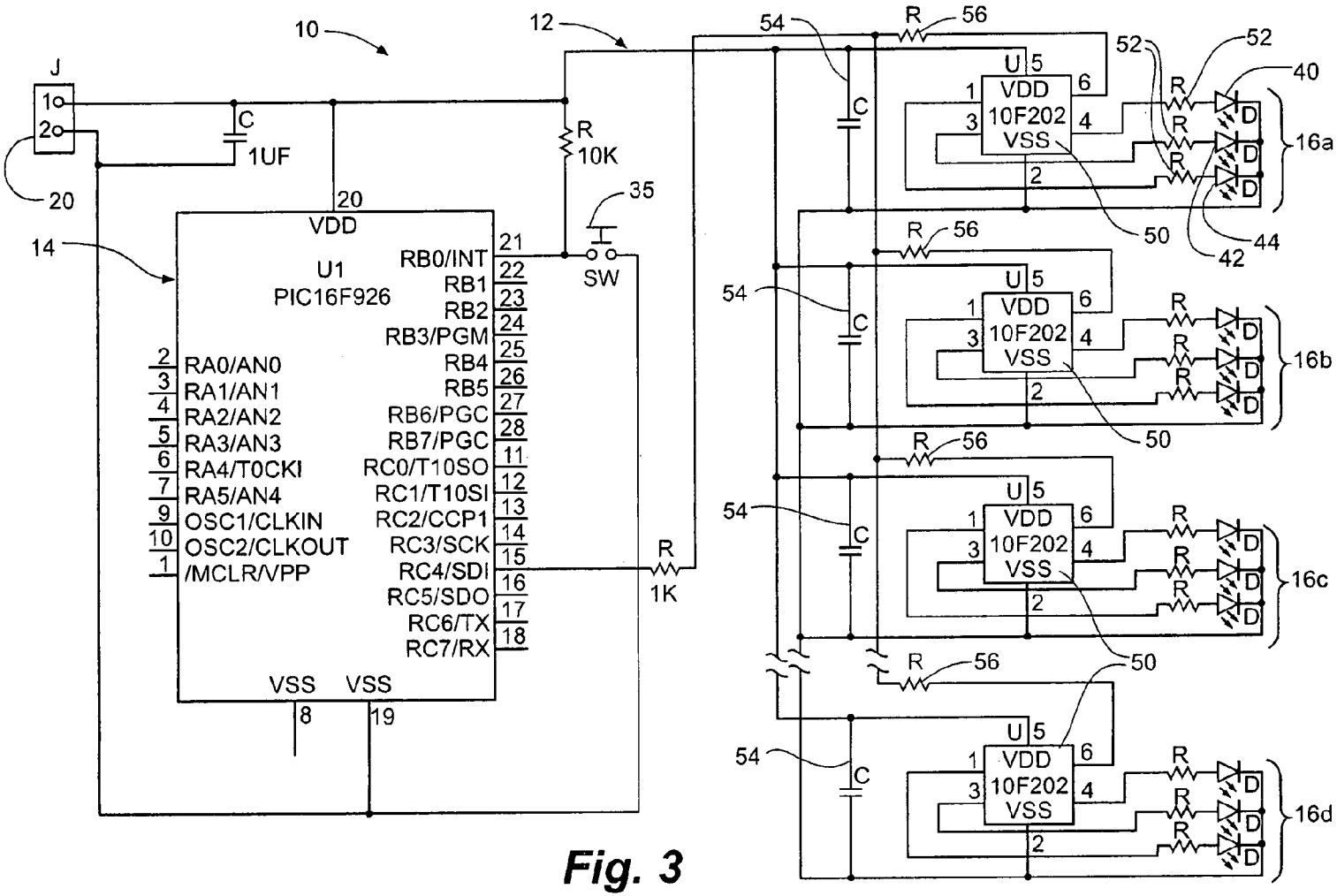
FIG. 3 is a circuit diagram of one embodiment of a light string of the present invention.

As depicted in FIG. 3 the main microprocessor 14 may include a switch 35 that permits an operator to toggle between the programs stored in the main microprocessor 14 in order to vary the display of light source assembly 16 and the plurality of the individual light source assemblies 16 as a whole, as desired. In another embodiment, the microprocessor may be pre-programmed.

Communication from the main microprocessor 14 to the light source assemblies 16 may use the RS232 protocol. As noted above, the communication may be serial. A single wire of the three wire communication 28 sends data from the primary microprocessor 14 to all of the individual light source assemblies 16 at the same time. The preferred basic sequence of this communication is: first P/Not P byte is communicated, then the address byte is communicated, and finally the color byte is communicated. It should be noted that each light source assembly 16 has its own unique address such that messages intended for another light source assembly 16 may be received by, but are not recognized by a certain light source assembly 16.

Figure 2:
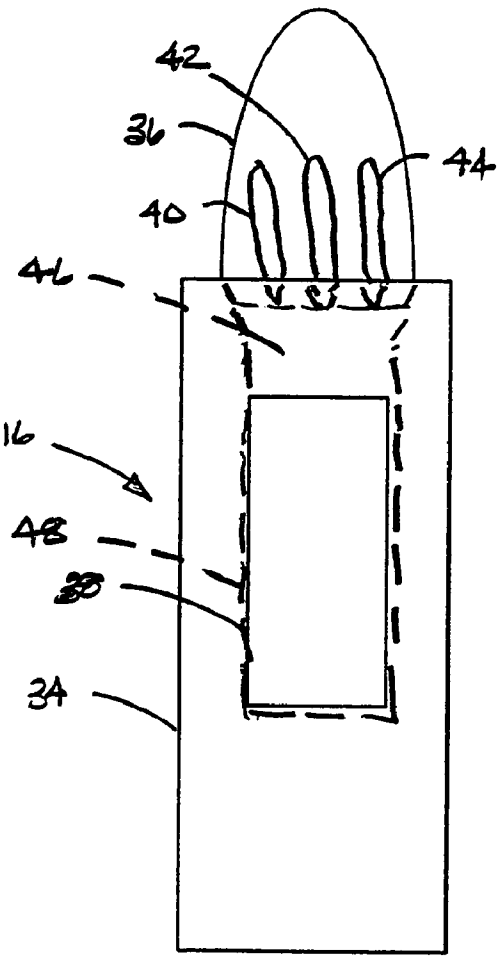
FIG. 2 is a representation of an individual bulb and socket of the present invention, including three light sources.

Turning to the light source assembly 16 of the variable effect light string 10, each light source assembly 16 includes a base 34, a translucent bulb 36, and an electronics package 38, as depicted in FIG. 2. Each of the light source assemblies 16 includes a plurality of LEDs. In one embodiment, there are three LED chips 40, 42, and 44 in each of the light source assemblies 16. In other embodiments, each light source assembly 16 may only have a single LED chip. Referring to FIG. 3, LED chip 40 may be red, LED chip 42 may be green, and LED chip 44 may be blue. Accordingly, each of the light source assemblies 16 is capable of producing any of the above-noted three colors, as well as any combination of the three colors illuminated at the same time. Combinations of the LED colors interact to produce colors other than the red, green, and blue. For example, illuminating the red and green LEDs visually simultaneously produces the color yellow or orange. The three LED chips 40, 42, and 44 are preferably in a single package, preferably in inside epoxy 46.

Preferably, only the three LED's 40, 42, and 44 are in inside epoxy 46 while the other components are on an external printed circuit board in the socket 48.

The other components of the electronics package 38, noted above and depicted in FIG. 3, include a microcontroller 50. In one embodiment, microcontroller 50 is a six-pin microcontroller. In other embodiments, "microcontroller" 50 may actually be any other type of microprocessor. Further, a current-limiting resistor 52 leads into each of the diodes 40, 42, and 44. A filtering capacitor 54 is employed with each of the electronics packages 38. In one embodiment, the filtering capacitor 54 is a 0.1 microfarad capacitor. Accordingly, each of the electronics packages 38 include three input terminals noted at 2, 5, and 6 on FIG. 3, the microcontroller 50, a reflection resistor 56, three current limiting resistors 52, capacitor 54, four output terminals (one to each of the three LEDs 40, 42, and 44 and one from the output of the LEDs 40, 42, and 44). It should be noted that the reflection reduction resistors 56 help to terminate reflection of the serial communication signal.

Figure 7:
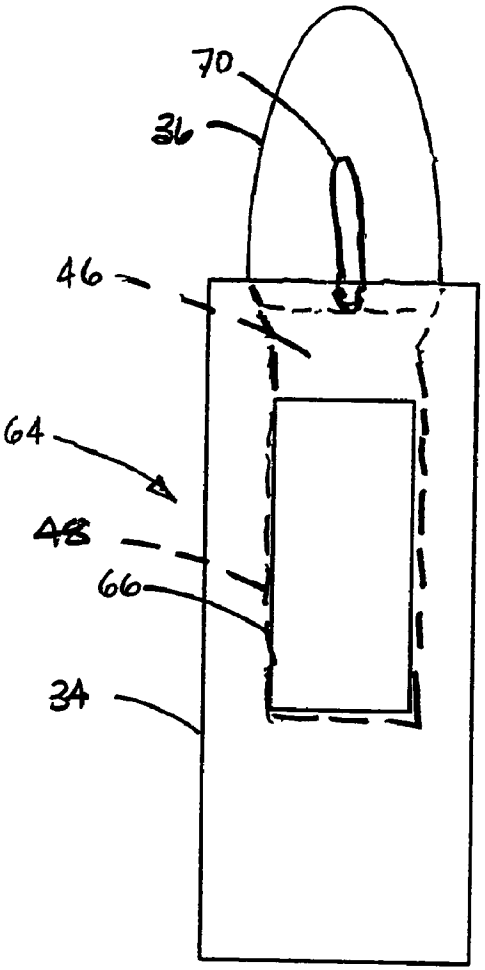
FIG. 7 is a representation of an individual bulb and socket of the present invention, including one light sources.

In another simplified embodiment of light string 10 of the present invention, a light source assembly 64 may be used instead of light source assembly 16. Light source assembly 64 includes only a single LED chip, as shown in FIG. 7. In this embodiment, each microcontroller 50 controls three light source assemblies 64. In this embodiment, electronics package 38 remains substantially the same as the prior embodiment described above, with the exception of reduced electrical components due to a single LED chip.

In operation, the 120 VAC power is reduced and transformed to 5 VDC by the AC/DC transformer 20. The 5 VDC is communicated from the AC/DC transformer 20 to the main microprocessor 14 along two wire communication 26.

The main microprocessor 14 stores a series of programs or lighting sequences. In addition to the two noted power communicating lines, the output of the microcontroller 14 includes a single serial RS232 communication line that sends data to the respective six pin microcontroller 50 in each of the plurality of light source assemblies 16.

Each of the microcontrollers 50 "listen" to the serial communication line to detect the address that is unique to each of the specific microcontrollers 50. Upon detecting the unique address, the specific microcontroller 50 responds to a subsequent command on the communication line to change color.

The communication sequence summary proceeds as follows. The first data sent to the microcontroller 50 initially determines if the microcontroller 50 should pay attention to any subsequent data (a P/Not P code is unique to each of the microcontrollers 50 in order to prevent interconnection of sets with other manufacturers' sets). The second data sent is the address byte and includes a universal address; and the third data sent is the color byte. Individual LEDs 40, 42, and 44 are either turned on or are toggled to achieve a unique color and, at a higher level timing, may create other visual effects. The operator selects the pattern/program/lighting sequence via the switch 35 at the main microprocessor 14. Various selections of the switch 35 acts to toggle various memory addresses in the microprocessor 14 which in turn accesses different program/sequences stored at different memory locations in the microprocessor 14. Accordingly, a different data stream is sent out of the microprocessor 14 to the plurality of microcontrollers 50 in order to alter the visual effect being produced by the light string 10 responsive to a specific operator selection at the switch 35.

A universal address may be used in conjunction with an individual address to each of the microcontrollers 50. If an individual microcontroller 50 sees its own individual address it changes color per the subsequently transmitted color byte. If the individual microcontroller 50 sees one of several universal addresses, it will also change color per the subsequently transmitted color byte. For example, the universal address zero turns on all light source assemblies 16 of the light string 10.

As noted above, the light string 10 can be used with a PC 30 or a LAN 32. In such case, instead of a microprocessor 14 with fixed or stored programs, the computer 30 or the LAN 32 can be connected to the microprocessor 14 and programs generated in the computer 30 or the LAN 32 will stream to the LED microcontrollers 50.

High frequency toggling of the individual LEDs 40, 42, and 44 is not noticeable to the eye when creating a new color, for example toggling (very rapid switching between) red and green to get yellow or orange. When the microcontroller 50 transitions, the toggling stops for a short period of time during this transition. During the transition then only one of the colors is on that is transitioning from toggling red and green to yield yellow to another toggled color, i.e. either the red or the green will be illuminated and the yellow will cease to be visually generated. During such transitions, the eye may perceive a tiny bit of flicker. The transition time is due to time lag in the microcontroller 50. Although it would be possible to remove such flicker in the future with pulse-width modulation (PWM) techniques, the simplicity, reliability and low-cost features of the light string of the present invention outweigh the visual distraction of a limited amount of perceived flicker.

Figure 3A:
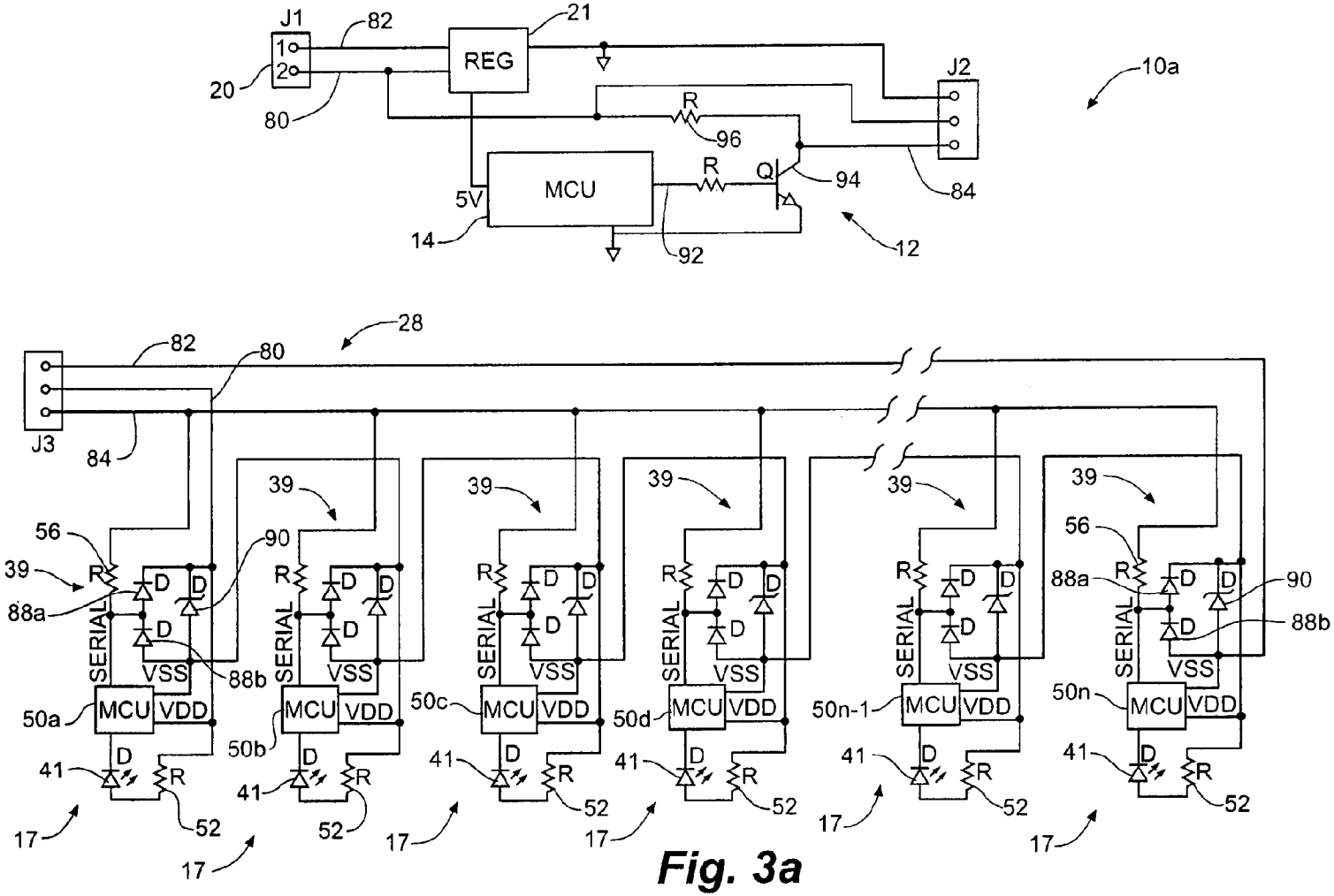
FIG. 3*a* is a circuit diagram of another embodiment of a light string of the present invention.

Referring now to FIG. 3*a*, another embodiment of the light string of the present invention, light string 10*a*, powers microcontrollers 50 serially in order to reduce the magnitude of current flowing through the light string. In this embodiment, the communication scheme employed by light string 10*a* is the same as that described above for light string 10. Further, unless otherwise noted, the description above relating to light string 10 also applies to light string 10*a*.

In this embodiment, light string 10*a* also includes three major subcomponents, a communication system 12, main microprocessor 14, and a plurality of light source assemblies 17.

The three wire communication 28 of the communication system 12, comprising VDD (high) line 80, VSS (low) line 82 and serial communication line 84, establishes communication between the main microprocessor 14 and each of the light source assemblies 17. In this embodiment, VDD line 80 of three wire communication 28 may be a voltage higher than the 5V used in light string 10, while VSS may be tied to ground as depicted. As such, communication system 12 of light string 10*a* may include a voltage regulator 21 to reduce the voltage supplied to main microprocessor 14. For example, in one embodiment, main microprocessor 14 requires a 5VDC input, which is supplied by voltage regulator 21.

Figure 2A:
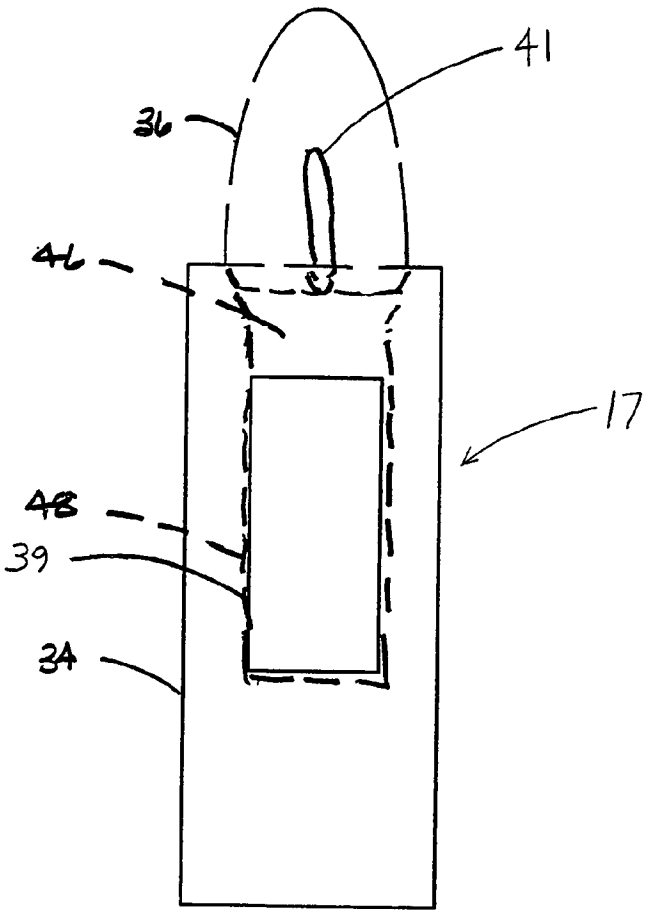
FIG. 2*a* is a representation of an individual bulb and socket of the present invention, including a single light source.

Referring now to FIG. 2*a*, light source assemblies 17 of light string 10*a* differ from light assemblies 16 of light string 10 primarily with respect to the electronics package. Electronics package 39 is included in light string 10*a* rather than electronics package 38. Further, in the embodiment depicted in FIGS. 3*a* and 2*a*, light string 10*a* includes a light source assembly 17 that includes a single LED chip 41, rather than a light source assembly 16 that includes multiple LED chips. In other embodiments, light source 17 may include multiple LED light sources, rather than a single LED.

Referring again to FIG. 3*a*, electronics package 39 includes a microcontroller 50, optional filtering capacitor 54 (not shown in FIG. 3*a*), reflection device 56, diodes 88*a* and 88*b*, zener diode 90, and a number of input and output terminals as needed.

In this reduced current embodiment, light string 10*a* includes a plurality of light source assemblies 17, each of which contains an electronics package 39, which in turn includes a microcontroller 50. As such, and as depicted in FIG. 3*a*, light string 10*a* includes a first microcontroller 50*a*, a second microcontroller 50*b*, a third microcontroller 50*c*, and so on, up to an nth microcontroller 50*n*.

Unlike the above-described light string 10 in which the microcontrollers 50 are all connected in parallel to VDD and VSS, the microcontrollers of light string 10*a* are connected in series to VDD and VSS. In the embodiment depicted in FIG. 3*a*, VDD line 80 is directly connected to the positive power supply pin Vdd of microcontroller 50*a*. The negative power supply pin Vss of microcontroller 50*a* is connected to the positive power supply pin Vdd of microcontroller 50*b*. Similar connections are made to and between the power supply pins of the intermediate microcontrollers, up to the last microcontroller 50*n*. The positive power supply pin Vdd of microcontroller 50*n* is connected to the negative power supply pin Vss of microcontroller 50*n*−1, while the negative power supply pin Vss of microcontroller 50*n* is directly connected to grounded main VSS line 82.

At each microcontroller 50, a zener diode 90, or other similar fixed voltage device is connected to the negative and positive supply pins Vss and Vdd of the microcontroller. In some embodiments, zener diode 90 may be replaced with other types of diodes or devices that would maintain a constant voltage drop across Vss and Vdd.

A pair of clamping diodes 88*a* and 88*b* are connected in parallel with zener diode 90. Clamping diodes may be any known diode designed to handle the power requirements of each particular light string 10*a*. In some embodiments, clamping diodes 88*a* and 88*b* may also have a minimal threshold voltage so as to prevent the serial input to microcontroller 50 from receiving a voltage greater than the recommended maximum voltage. In one embodiment, clamping diodes 88*a* and 88*b* are silicon diodes with 0.6 to 0.7V threshold voltages.

Serial communication line 84 is connected through an optional reflection resistor 56 to both a serial input pin of microcontroller 50, and to the anode of diode 88*a* and the cathode of 88*b*.

In operation, the voltage potential between VDD and VSS will be equal to the sum of the voltage drops at each microcontroller 50. In this embodiment, zener diode 90 maintains a substantially constant voltage drop across Vdd and Vss of each microcontroller. Therefore, the voltage potential between VDD and VSS will be approximately equal to the number of microcontrollers in a series circuit of light string 10*a*. In one embodiment, for example, for a light string 10*a* with one series circuit of ten microcontrollers 50, each with a 3.0V zener diode, VDD−VSS will be approximately 30 volts DC.

Although the voltage differential across each the positive and negative power supply pins at each microcontroller will be relatively constant, and equal to the voltage drop across its associated zener diode 90, the voltage potential with respect to ground at the positive pins Vdd varies from microcontroller to microcontroller, as does the negative voltage at the negative pins, Vss. At microcontroller 50*a*, the positive power supply pin Vdd will see VDD, the negative power supply pin Vss will see VDD less the zener diode 90 voltage drop, which is in this example, 3V. The second microcontroller 50*b* will have approximately VDD less 3V at its positive power supply pin Vdd, and VDD less 6V at its negative power supply pin Vss. Each subsequent power pin voltage drops by the value of the zener diode 90 voltage drop, until the last microcontroller in the series, microcontroller 50*n* has VSS plus 3V at its positive power supply pin Vdd and VSS at its negative power supply pin, Vss. As such, each microcontroller 50 is operated at a relatively equal fraction of VDD less VSS volts.

As depicted in FIG. 3*a*, and described above with respect to FIG. 3, serial communication line 84 transmits serial data from main processor 14 to each microcontroller 50. In the embodiment depicted in FIG. 3*a*, serial output pin 92 of main microcontroller 14 switches transistor 94 on and off. Resistor 96 is a relatively high-value resistor such that the voltage drop across resistor 96 is relatively small. As main microcontroller 14 switches transistor 94 on and off, the voltage at serial communication line 84 correspondingly switches low (substantially ground in this embodiment) and high (substantially VDD in this embodiment), thereby communicating digital data to microcontrollers 50.

In this embodiment, logic low is ground, while logic high is VDD. Therefore, as the number of microcontrollers 50 increases in light string 10*a*, the required voltage potential VDD−VSS increases, causing the logic high voltage on line 84 to also increase. In most cases, microcontrollers 50 are only capable of receiving a relatively low voltage data input at their serial data input pins, which in some embodiments is in the range of 3 VDC to 5 VDC.

To ensure that the voltage seen at the serial input of each microcontroller 50 does not vary as the number of microcontrollers 50 varies, clamping diodes 88*a* and 88*b* are used at the input of each microcontroller 50 as depicted. In the embodiment depicted, as serial communication line is toggled high and low (approximately VDD and VSS), diodes 88*a* and 88*b* will respectively conduct. Therefore, for a logic high condition, diode 88*a* conducts, the voltage potential seen at serial input to microcontroller 50 will be approximately equal to Vdd plus the drop across diode 88*a* less Vss. At logic low, diode 88*b* conducts, and the voltage potential seen at the serial input to microcontroller 50 will be approximately Vss less the voltage drop across diode 88*b* and less Vdd.

To illustrate this operation further, in an embodiment where n=10, 3.0V zener diodes 90 are used, 0.7V silicon diodes 88 are used, and VSS is connected to ground, VDD and "logic high" are 30 VDC. Vdd at microcontroller 50*a* is VDD, or 30 VDC, while Vss is equal to VDD less the voltage drop across zener diode 90, or 27 VDC. When line 84 is toggled to logic high, diode 88*a* is forward biased and conducts, clamping the voltage input to VDD plus 0.7V, or 30.7 VDC. Because Vss is equal to VDD less the voltage drop across zener diode 90, Vss is equal to VDD minus 3.0V, or 27 VDC. Therefore, the voltage potential seen at microcontroller 50*a* is 3.7 volts for a logic high. For a logic low condition, diode 88*b* conducts, and a slightly negative voltage, −0.7 VDC is seen at the input to microcontroller 50*a*.

Although Vdd and Vss vary from microcontroller to microcontroller, the potential between Vdd and Vss remains fixed at the zener diode 90 voltage, and the communication inputs or voltages at each microcontroller are clamped to operate within a range acceptable to the microcontroller 50. At the same time, the differential clamping design protects each microcontroller from being damaged in overvoltage or undervoltage situations.

Furthermore, in this embodiment, because light string 10*a* is being operated at a significantly higher voltage as compared to the parallel construction embodiment of light string 10*a*, and of other previously known light strings, the overall current flowing through light string is significantly lower. Although the overall power is theoretically the same, the reduced current flow allows smaller diameter wires to be used in the construction of light string 10*a*. Smaller diameter wires results in a significant reduction in manufacturing costs, and reduces the overall size of light string 10*a*, increasing its aesthetic appeal and application options.

In an alternate embodiment of the light string of the present invention, main controller 14 is connected to a series of flip-flops 60, rather than a series of microcontrollers 50. Flip flops 60 may be a D, SR, JK, or other type of flip flop. In one embodiment, flip-flops 60 are D flip-flops. In this embodiment using T flip-flops, clock signal 66 synchronizes the operation of flip-flops 60, while data 68, in the form of sequential data bits corresponding to high or low logic states, is transmitted from main controller 15 to flip flops 60. A data sequence of one embodiment is comprised of a series of data bits, where the number of data bits matches the number of light source assemblies 64. As in the previous microcontroller-based embodiments, the output of the microcontroller 14 includes a single serial RS232 communication line. Other serial data communications in addition to RS232 may be used. Current limiting resistors 62 lead into each light source assembly 64.

Turning to the light source assembly 64 of the variable effect light string 10, each light source assembly 64 includes a base 34, a translucent bulb 36, and an electronics package 66, as depicted in FIG. 7. In the embodiment shown in FIG. 7, each of the light source assemblies 64 includes a single LED 70, preferably located inside epoxy 46. In other embodiments, light source assemblies 64 may include more than one LED 70, with the same or different color outputs. Other components of the electronics package 66, noted above and depicted in FIG. 7, may include current limiting resistor 62, a filtering capacitor 54, and reflection/ringing resistor 56.

Figure 6:
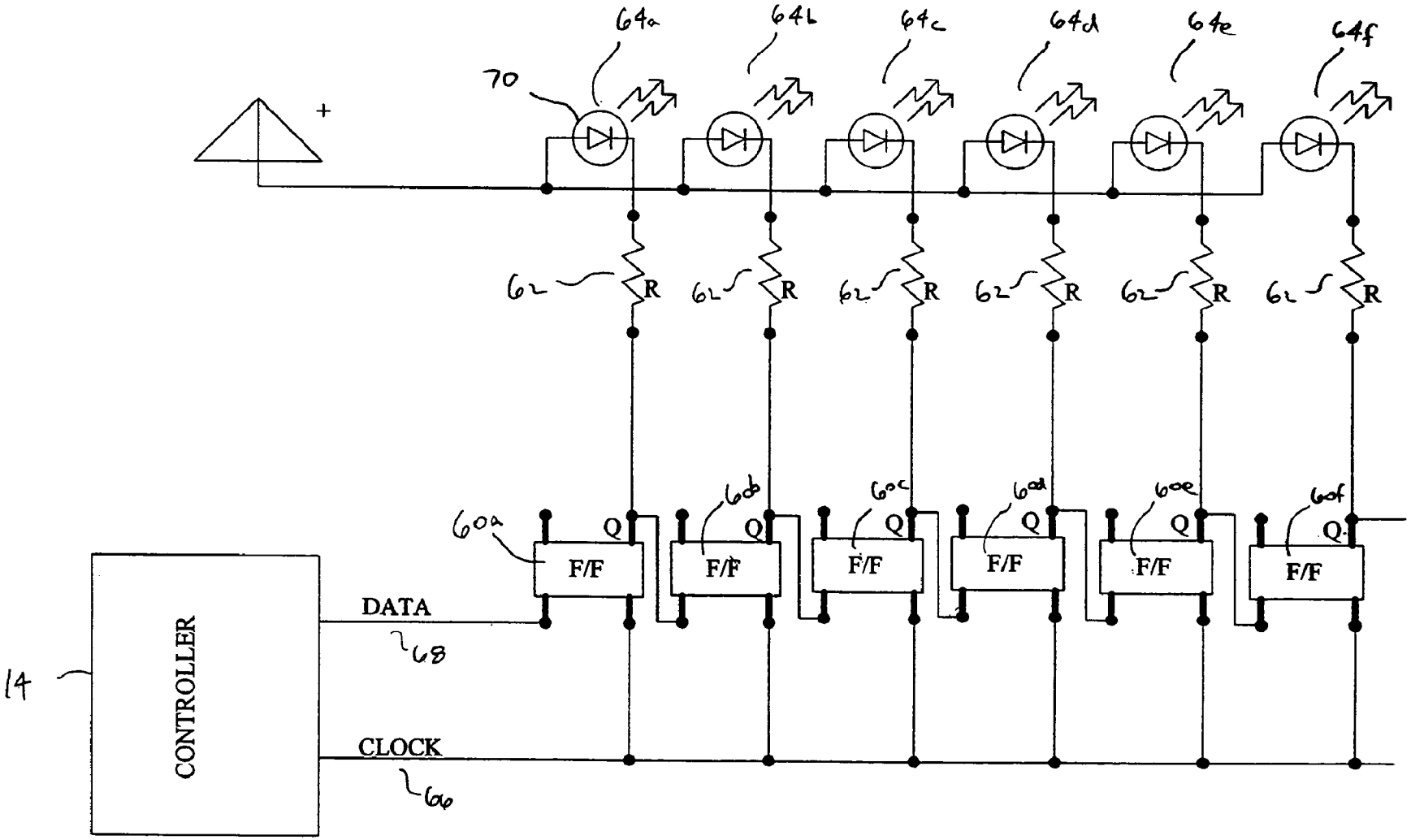
FIG. 6 is a circuit diagram of another embodiment of the light string of the present invention that uses a clock and flip-flops instead of microcontrollers.

Referring to FIGS. 6 and 7, data 68 streams serially from main controller 14 to a first flip-flop 60*a*. Output Q of flip flop 60*a* is connected to the input to flip flop 60*b*. Output Q of flip flop 60*b* is connected to the input to flip flop 60*c*, and so on. Clock signal 66 is input in parallel to each flip flop 60. Data 68 arrives at each flip-flop 60 as a high or low voltage, corresponding to a high or low logic state. Output Q of the flip-flop also corresponds to a high or low logic state. High logic states power LEDs 70 on, while low logic states turn off LEDs 70. Data 68 arrives at a flip-flop 60, and when clock signal 66 transitions from low to high, output Q of flip flop 60 reflects the high or low logic state of data 68. If output Q is high, LED 70 is on, if low, LED 70 is off. Note that depending on the particular type of flip-flop 60 used, output Q may transition on the falling edge of clock signal 66.

As data 68 passes serially from flip-flop to flip-flop with each transition of clock signal 66, LEDs 70 turn on, turn off, remain on, or remain off, causing light string 10 to exhibit a visual effect. The particular visual effect is based on a data pattern stored in main controller 14 which is output as data 68. For example, if data 68 is a series of high logic data bits followed by a series of low data bits, alternating back and forth, LEDs 70 will alternately turn on and off. A variety of patterns can be created and stored in main controller 14 and transmitted through flip-flops 60 to create a variety of visual effects. Data 68 travels sequentially through flip-flops 60 at a rate determined by the frequency of clock signal 66. If light string 10 includes a large number of light source assemblies 64, a human eye might be able to perceive the transition between data patterns as a new pattern streams from flip-flop to flip-flop.

Figure 8:
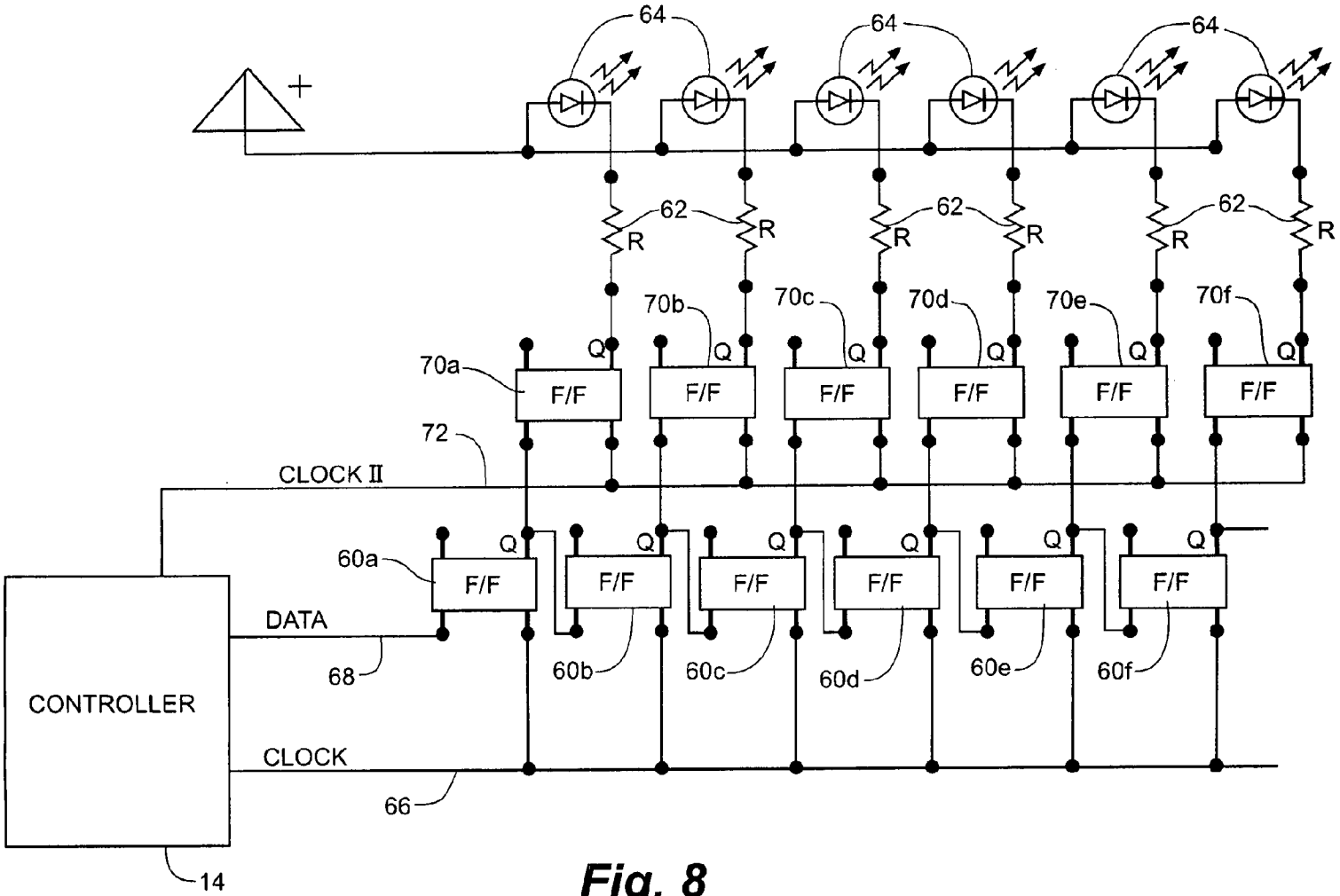
FIG. 8, is a circuit diagram of yet another embodiment of the light string of the present invention that uses multiple clocks and a pair of flip-flops for each light source assembly.

In another embodiment of the invention shown in FIG. 8, a pair of flip-flops 60 and 70 is used for each light source assembly 64, as well as a second clock signal 72. Outputs Q of flip-flops 60 are connected to flip-flops 70 inputs. Clock signal 72 is transmitted in parallel to flip-flops 70. As in the previous embodiment, data 68 is transmitted sequentially to each flip-flop 60. Each flip-flop 60 loads a new data bit with each clock 66 transition. Flip-flops 70 load output Q of flip-flops 60 with each clock 72 transition. Output Q of flip-flops 70 then control LED assemblies 64. Flip-flops 60 may be clocked by clock signal 66 at a frequency that is substantially equal to the frequency of clock signal 72 times the number of LED assemblies 64, such that the combination of flip-flops 60 and 70 functions much like a serial-in, parallel-out shift register.

This embodiment can be advantageous, especially when the number of light source assemblies 64 is large. For example, data 68 is loaded serially into flip-flops 60. The time that it takes for the first data bit in a sequence to travel from first flip-flop 60*a* to the last flip-flop will depend on the clock frequency and the number of flip-flops 60 or light source assemblies 64. After the first data bit of data 68 reaches the last flip flop 60, second clock signal 72 will trigger flip-flops 70 to output data 68 as it appears at the output of flip-flops 60. In other words, there is a parallel loading of data 68 to flip-flops 70, which turns light source assemblies 64 on or off, creating the desired lighting effect. Since data 68 is transferred to flip-flops 70 in parallel, all light source assemblies 64 turn on or off at the same time, eliminating flicker. In the embodiment of FIG. 7, if a large number of light source assemblies is used, light source assemblies turn on or off as each data bit of data stream 68 is transmitted from flip-flop to flip-flop. This creates a flicker effect that may be perceived by the human eye if the number of light source assemblies is large enough.

Having thus described particular embodiments of the invention, various alterations, modifications, and improvements will readily occur to those skilled in the art. Such alterations, modifications and improvements as are made obvious by this disclosure are intended to be part of this description though not expressly stated herein, and are intended to be within the spirit and scope of the invention. Accordingly, the foregoing description is by way of example only, and not limiting. The invention is limited only as defined in the following claims and equivalents thereto

What is claimed is:

1. A decorative light string for creating variable lighting effects, comprising: a main processor; a plurality of light source assemblies, each having a distinct address known to the main processor, each of the plurality of light source assemblies including one or more light sources and a microprocessor, wherein the microprocessors of the light source assemblies are powered serially; and a serial communication line adapted to transmit lighting effect data to the microprocessor; and further comprising a fixed voltage device connected across the negative and positive power pins of each microprocessor and wherein each of the plurality of light source assemblies further comprises a clamping diode device in parallel with the fixed voltage device.

2. The decorative light string of claim 1, further comprising a zener diode connected across the negative and positive power pins of each microprocessor.

3. The decorative light string of claim 2, wherein the fixed voltage device is a zener diode.

4. A decorative light string according to claim 1 wherein light source assemblies, each having at least one light source and at least one flip-flop device; wherein the lighting effect data is transmitted to the flip-flop devices thereby controlling the light sources and creating a lighting effect.

5. The decorative light string of claim 4, wherein the flip-flop devices are electrically connected in series such that the lighting effect data is transmitted sequentially through at least one flip-flop device in each light source assembly.

6. The decorative light string of claim 5, wherein each light source assembly includes a first and a second flip-flop device, wherein the first flip-flop devices sequentially receive the transmitted data from the main processor and other first flip-flop devices, and the second flip-flop devices receive the lighting effect data in parallel from the first flip-flop devices.

7. The decorative light string of claim 4, wherein the flip-flop devices are selected from the group consisting of T flip-flop devices, D flip-flop devices, SR flip-flop devices, and JK flip-flop devices.

8. The decorative light string of claim 1, wherein the lighting effect data contains a plurality of data patterns to create a plurality of lighting effects.

9. The light string according to claim 1 further including a reflection resistor in communication with the microprocessor and with the main processor, the reflection resistor for minimizing a reflection of a communication to the microcontroller.

10. The light string of claim 1 further including a first resistor in communication with the microprocessor and with one of a plurality of light sources.

11. A decorative light string for creating variable lighting effects, comprising: a main processor; a plurality of light source assemblies, each having a distinct address known to the main processor, each of the plurality of light source assemblies including one or more light sources and a microprocessor, wherein the microprocessors of the light source assemblies are powered serially; and a serial communication line adapted to transmit lighting effect data to the microprocessor; and further comprising a fixed voltage device connected across the negative and positive power pins of each microprocessor and wherein a voltage transmitted by the communication line is approximately equal to the number of microprocessors powered serially times the voltage potential between a negative and positive power supply pin of each microprocessor, plus the voltage drop of any other components wired in series with the microprocessors.

12. A method of creating a visual lighting effect in a light string, comprising: assigning a distinct address to a plurality of light source each powered by a microprocessors in series such that a negative power supply of each microprocessor is connected to a positive power supply of another microprocessor for a majority of the plurality of microprocessors, and communicating serial data over a common communication line from a main processor to the light source assemblies; receiving the serial data at the plurality of microprocessors; powering a plurality of light sources in accordance with the serial data received at the plurality of microprocessors to generate a lighting effect.

13. The method of claim 12, wherein the serial data comprises a high voltage transmitted to the light source assemblies, wherein the high voltage is greater than the voltage between the negative and positive power supply pins of any individual microprocessor.

* * * * *